US008103205B2

(12) United States Patent
David et al.

(10) Patent No.: US 8,103,205 B2
(45) Date of Patent: Jan. 24, 2012

(54) IMAGING SYSTEM AND METHOD WITH REDUCED THERMAL STRESS ON A SUBSTRATE

(75) Inventors: Biegelsen K. David, Portola Valley, CA (US); Swartz E. Lars, Sunnyvale, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 385 days.

(21) Appl. No.: 12/355,423

(22) Filed: Jan. 16, 2009

(65) Prior Publication Data

US 2010/0183344 A1 Jul. 22, 2010

(51) Int. Cl.
*G03G 15/20* (2006.01)
*G03G 15/00* (2006.01)

(52) U.S. Cl. ..... 399/341; 399/322; 399/401

(58) Field of Classification Search ..... 399/67, 399/68, 69, 322, 341, 401, 407
See application file for complete search history.

(56) References Cited

U.S. PATENT DOCUMENTS

| | | | | |
|---|---|---|---|---|
| 4,959,693 | A * | 9/1990 | Mitsuya et al. | 399/322 |
| 5,890,032 | A * | 3/1999 | Aslam et al. | 399/69 |
| 6,512,914 | B2 * | 1/2003 | Kabashima | 399/341 |
| 6,615,018 | B2 * | 9/2003 | Funato | 399/322 |
| 2004/0005178 | A1 | 1/2004 | Frohlich | |
| 2006/0067756 | A1 | 3/2006 | Anderson | |
| 2007/0071465 | A1 | 3/2007 | Hamby | |
| 2007/0297839 | A1 * | 12/2007 | Omata | 399/341 |
| 2008/0090161 | A1 * | 4/2008 | Ishiduka | 399/341 X |

* cited by examiner

*Primary Examiner* — Sandra Brase
(74) *Attorney, Agent, or Firm* — Marger Johnson & McCollom, P.C.

(57) ABSTRACT

An imaging system including an image transfer structure configured to transfer marking material to a first side of a substrate; a tacker configured to fix the marking material to the substrate; a path controller; a substrate inverter; and a fuser. The path controller is configured to switch the substrate between a first path towards the fuser and a second path extending through the substrate inverter and returning to the image transfer structure.

19 Claims, 3 Drawing Sheets

IMAGING SYSTEM AND METHOD WITH REDUCED THERMAL STRESS ON A SUBSTRATE

BACKGROUND

This disclosure relates to an imaging system, method of imaging, and, in particular, to an imaging system and method of imaging with reduced thermal stress on a substrate.

In duplex printing, a sheet with an image printed on a first side is inverted and returned to an image transfer nip to printing on a second side. However, the image on the first side is fused to the sheet before being returned to the image transfer nip for printing on the second side. During the fusing process, dimensional changes can occur in the sheet. As a result, alignment of images on the first and second sides of the sheet can be difficult or impossible. In addition, fusers can be particularly long. As a result, the return path after fusing can be relatively long, affecting throughput and/or introducing additional complexity. Furthermore, fusing chemicals or other fusing induced changes can contaminate the image transfer nip and/or cause other problems with subsequent imaging.

SUMMARY

An embodiment includes an imaging system including an image transfer structure configured to transfer marking material to a first side of a substrate; a tacker configured to fix the marking material to the substrate; a path controller; a substrate inverter; and a fuser. The path controller is configured to switch the substrate between a first path towards the fuser and a second path extending through the substrate inverter and returning to the image transfer structure.

Another embodiment includes a method of printing including fixing marking material to a first side of a substrate in a tacker without fusing the marking material to the first side of the substrate; switching the substrate between a first path towards a fuser and a second path; inverting the substrate along the second path; returning the inverted substrate to the tacker; and fixing marking material to a second side of the substrate in the tacker.

DETAILED DESCRIPTION OF THE EMBODIMENTS

Figure 1:
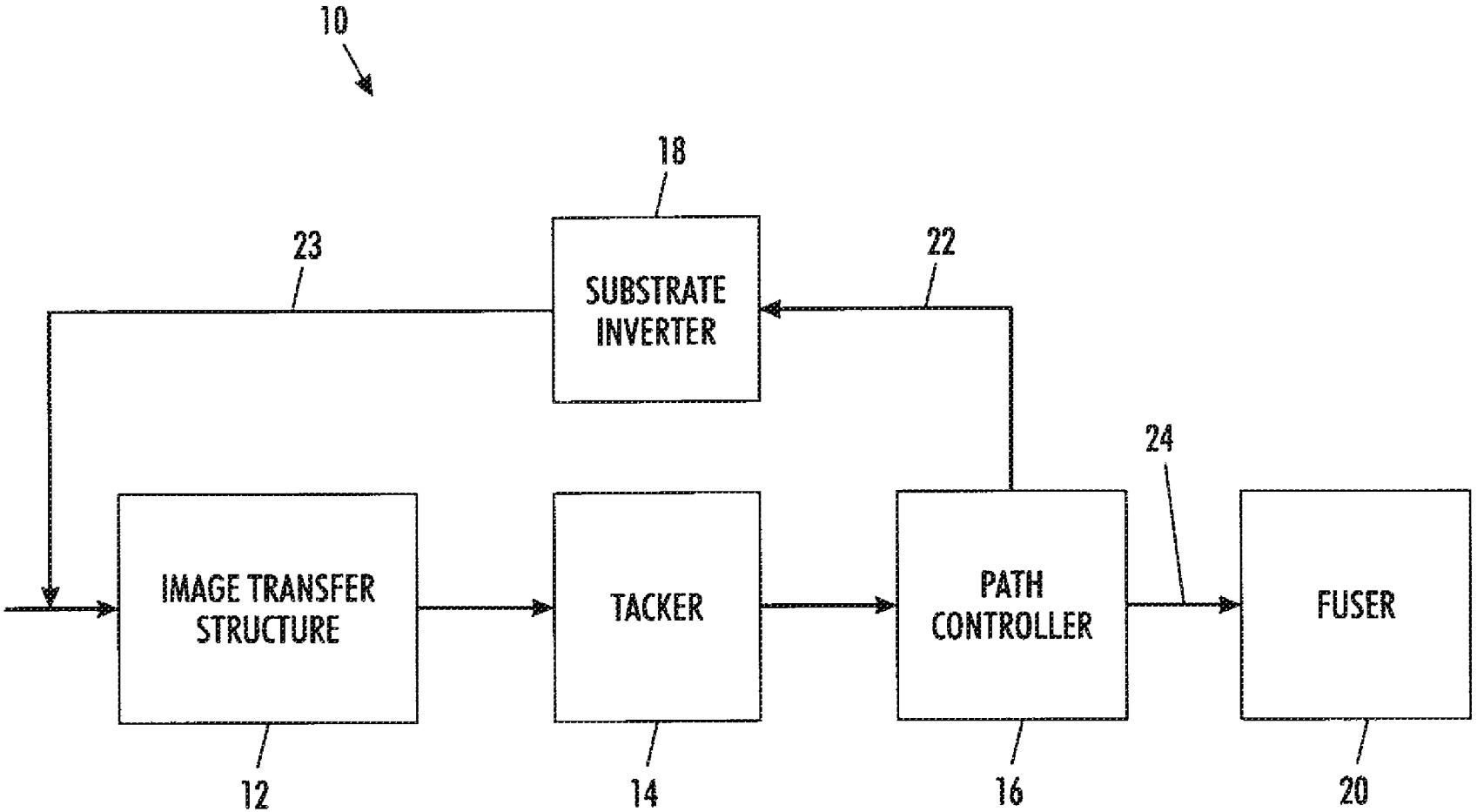
FIG. 1 is a block diagram of an imaging system according to an embodiment.

Embodiments will be described with reference to the drawings. In particular, marking material can be fixed to multiple sides of a substrate prior to fusing. FIG. 1 is a block diagram of an imaging system according to an embodiment. The imaging system 10 can be a printer, copier, facsimile machine, multi-function device, or the like. That is, in an embodiment, the imaging system 10 can be any system that can transfer marking material to a substrate where that marking material can be fused to the substrate.

The imaging system 10 includes an image transfer structure 12, a tacker 14, a path controller 16, a substrate inverter 18, and a fuser 20. The image transfer structure 12 is configured to transfer marking material a substrate. The image transfer structure 12 can be any variety of structures. For example, the image transfer structure 12 can use a xerographic technique, an ink jet technique, or any other technique of transferring marking material to a substrate. In an embodiment, the image transfer structure 12 can be configured for digital printing of marking material. That is, the image transfer structure 12 need not supply the same image to the substrate. Moreover, in an embodiment, the image transfer structure 12 is configured to transfer marking material to only a single side of the substrate.

As used herein, marking material can be any variety of materials that can be fused to a substrate. For example, marking materials can include toner, water-based inks, waterless inks, or the like.

The tacker 14 is configured to fix the marking material to the substrate. As used in this disclosure, fixing is the technique of adhering marking material to a substrate. However, fixing is distinguished from fusing in that the marking material does not reflow and/or the marking material does not obtain a gloss. In particular, fixing can be performed at lower temperatures and/or pressures than necessary to fuse marking material to a substrate.

The tacker 14 can include any variety of different structures, depending on the marking material, substrate, desired throughput, or the like. For example, the tacker 14 can include radiant heaters, convection heaters, pressure rollers, contact or contactless systems, or the like.

Although the tacker 14 has been described as being configured to fix the marking material, the tacker 14 can, but need not be limited to only fixing. For example, in an embodiment, the tacker 14 can be a structure that is capable of fusing marking material to the substrate, but is also configurable to supply less heat, pressure, or the like to only fix the marking material to the substrate. As a result, such a tacker 14 can be configured to fix the marking material.

In an embodiment, the tacker 14 can be configured to fix marking material to only a single side of the substrate. For example, the tacker 14 can be configured to apply different amounts of heat to the sides of the substrate. As a result, a sufficient amount of heat can be applied to one side of the substrate to fix the marking material, while lesser amount, insufficient to fix the marking material, can be applied to another side of the substrate.

The path controller 16 can be any variety of structures suitable for controlling a path of the substrate. The path controller 16 can include rollers, air jets, mechanical gates, or the like to affect the path of the substrate. For example, the path controller 16 is configured to switch the substrate between a first path 24 towards the fuser and a second path 22 extending through the substrate inverter 18 and returning to the image transfer structure 12. In another example, a reversing structure can reverse a direction of the substrate so that a different side of the substrate is presented to the image transfer structure 12.

The substrate inverter 18 can be any variety of structures that can change an orientation of a substrate. For example, the substrate inverter 18 can include rollers, air jets, mechanical gates, reversing structures, or the like. In an embodiment, the substrate inverter 18 can include a path that rotates the substrate such that when the substrate arrives at the image transfer structure 12, a different side of the substrate is presented for imaging.

The fuser 20 is configured to fuse marking material to the substrate. That is, the fuser 20 is configured to supply a sufficient amount of heat, pressure, or the like to fuse the marking material to the substrate. In addition, the fuser 20 can be configured to control an amount of gloss of the fused marking material.

In an embodiment, the fuser 20 can be configured to heat the substrate to greater than or equal to a threshold temperature. In contrast, the tacker 14 can be configured to heat the substrate to less than the threshold temperature. This threshold temperature can be a temperature between temperatures at which the marking material adheres to the substrate and temperatures at which the marking material fuses and/or reflows on the substrate. For example, such a temperature can be about 80° C. At a lower temperature, such as about 70° C., marking material can be fixed to a substrate; however at a higher temperature, such as about 100° C., the marking material can fuse to the substrate.

In an embodiment, the fuser 20 is configured to substantially symmetrically fuse marking material fixed to the first side of the substrate and fuse marking material fixed to the second side of the substrate. That is, the fuser 20 can fuse the marking material on multiple sides of the substrate substantially simultaneously by applying a substantially symmetrical amount of heat, pressure, or the like to the sides of the substrate.

However, in another embodiment, the different sides of a substrate may arrive at the fuser 20 at different temperatures. For example, the tacker 14 may have deposited some marking material later than other marking material on different sides of the substrate. Thus, the side of the substrate with the most recently deposited marking material may be at a higher temperature than marking material on other sides. Accordingly, different amounts of energy can be applied to the sides of the substrate. As a result, marking material on each side will be substantially symmetrically fused to the substrate.

Figure 2:
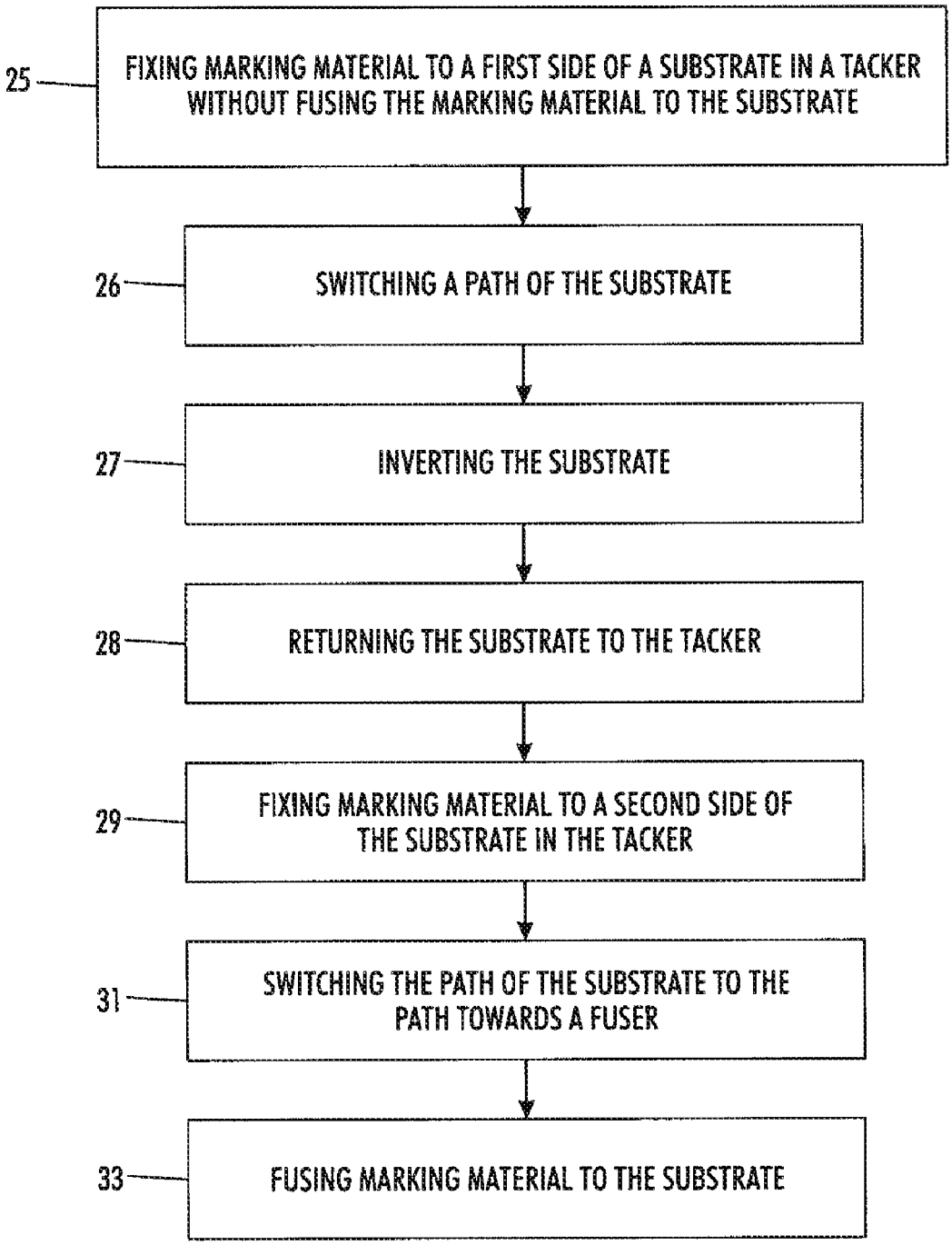
FIG. 2 is a flowchart illustrating an imaging technique according to an embodiment.

FIG. 2 is a flowchart illustrating an imaging technique according to an embodiment. FIG. 1 will be used as an example of an imaging system that can perform such an imaging technique. Referring to FIGS. 1 and 2, in 25, marking material is fixed to a first side of a substrate in a tacker 14 without fusing the marking material to the first side of the substrate. Thus, while the substrate is passing through the tacker 14, the marking material is only fixed.

In 26, the substrate is switched between a first path 24 towards a fuser 20 and a second path 22. For example, the switching can occur in the path controller 16. The control of the switching can, but need not occur immediately prior to the substrate reaching the path controller 16. That is, the switching can occur at some earlier point in time, the path controller 16 can be a pre-existing state, or the like. As a result, when the substrate reaches the path controller 16, the substrate is directed back towards the tacker 14.

In an embodiment, the substrate need not be switched to the second path 22. For example, if marking material is to be transferred to only one side of the substrate, the substrate can be switched to the first path 24 towards the fusing without being routed back for application and fixing of marking material.

In 27, the substrate is inverted along the second path. The inversion can include rotating, reversing, or the like. Thus, as used herein inversion is the presentation of a different side than one previously presented. In 28 the inverted substrate is returned to the tacker 14. The inversion of the substrate and the returning of the substrate can occur separately, or at substantially the same time. For example, the substrate can be sent to the substrate inverter 18 where it is reversed. Then the substrate follows path 23 towards the image transfer structure 12 and the tacker 14. Thus, the inversion and returning occurred sequentially. In another example, while travelling on the path 22 and 23 towards the tacker 14, the substrate can be rotated, as described above. Thus, the substrate is both inverted and returned substantially simultaneously.

In an embodiment, the substrate can be passed through the image transfer structure 12 where marking material is transferred to the substrate. Since the substrate was inverted, a second side of the substrate is presented to the image transfer structure 12 for transfer of marking material. The substrate can then continue to the tacker 14. At this point, the substrate can have marking material fixed to the first side of the substrate and marking material merely applied, but not fixed to the second side of the substrate. Once the substrate is returned to the tacker 14, marking material can be fixed to a second side of the substrate in the tacker 14 in 29. Thus, marking material can be applied to multiple sides of the substrate before fusing any of the marking material to the substrate.

In 31 the substrate is switched to the first path towards the fuser 20. The switching can occur after marking material has been fixed to as many sides of the substrate as desired. In this example, once marking material is fixed to the first and second sides of the substrate, the path controller 16 directs the substrate towards the fuser 20. As a result, in 33, the marking material can be fused to the substrate.

By fixing the marking material prior to fusing, a shorter path length can be achieved than if the marking material was initially fused to each side. For example, the path length through a tacker 14 can be shorter than a fuser 20. As a result a path length of a loop travelled by a substrate when imaging multiple sides is reduced, increasing throughput.

Moreover, as described above, a fuser 20 can subject the substrate to higher temperatures, pressures, or the like, leading the dimensional changes. However, since the substrate will only be subjected to temperatures, pressures, or the like sufficient for fixing, a smaller amount of dimensional changes will occur. As a result, the alignment of the marking material on the sides of the substrate can be improved.

In 33, the marking material is fused to the substrate. In an embodiment, the fusing can include substantially simultaneously fusing the marking material on the first side of the substrate and the marking material on the second side of the substrate to the substrate. As described above, the fuser 20 can be configured to apply the same or different amounts of energy to the substrate.

Although one pass of transferring marking material and fixing the marking material has been described for each side, marking material can be transferred and fixed in multiple passes for the same side. For example, marking material can be transferred and fixed to the first and second sides of the substrate through two passes through the image transfer structure 12 and tacker 14. The substrate then can be routed again along the second path 22 for an additional transfer of marking material to the first side, the second side, or both sides.

Figure 3:
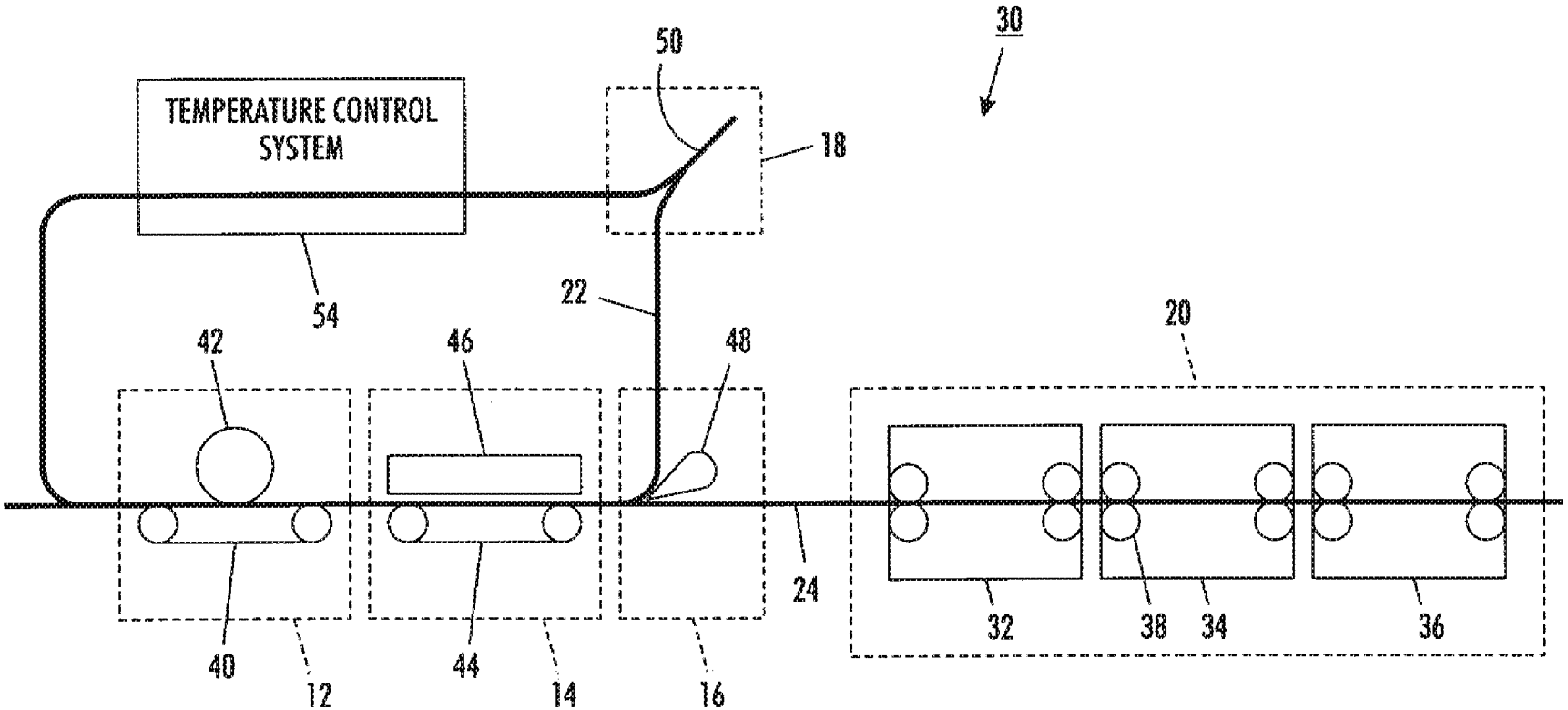
FIG. 3 is a block diagram of an imaging system according to another embodiment.

FIG. 3 is a block diagram of an imaging system according to another embodiment. In this embodiment, the imaging system 30 includes an image transfer structure 12, a tacker 14, a path controller 16, a substrate inverter 18, and a fuser 20 similar to FIG. 1. However, additional details are illustrated as examples.

The image transfer structure 12 includes a substrate transport 40. The substrate transport 40 can be configured to guide the substrate by the roller 42. Roller 42 can be, for example, a roller used in an offset printing technique where marking material is applied to the roller 42 through another structure (not illustrated). However, as described above, roller 42 can be replaced by any structure according to the particular technique of depositing marking material as described above.

Once the marking material is deposited on the substrate by the image transfer structure 12, the substrate is guided towards the tacker 14. In an embodiment, the tacker 14 can include a heated substrate transport 44 and a heat source 46. The heated substrate transport 44 can be configured to support the substrate from the second side. In addition, the heated substrate transport 44 can be configured to apply heat to the second side of the substrate. That is, the side of the substrate that did not recently receive marking material from the image transfer structure 12 can be heated, maintained at a particular temperature, or the like. In an embodiment, the heated substrate transport 44 can be a heated, smooth vacuum transfer belt.

In an embodiment, the heated substrate transport 44 is configured to limit the temperature of the second side of the substrate. For example, the temperature can be limited to a temperature below which any marking material on the second side is not substantially modified, embossed, changed, or the like in a perceptible way while the first side is fixed. Such a temperature can be below a temperature at which the marking material becomes fixed to the substrate.

In addition to limiting the temperature, the heated substrate transport 44 can also be configured to hold the second side of the substrate at a particular temperature that is less than a temperature sufficient to fix the marking material to the substrate. For example, the second side of the substrate can be limited to and/or held at about 60° C.; however, the particular temperature can vary with different marking materials.

In another embodiment, the heated substrate transport 44 can be configured to heat the second side of the substrate at a particular temperature that is less than a temperature sufficient to substantially disturb fixed marking material. That is, an amount of heat can be added to the second side; however, if any marking material was previously fixed to the second side, it will not be disturbed. As a result, the temperature of the second side can be controlled as desired while the impact on any fixed marking material is reduced.

The heat source 46 is configured to supply heat to the first side of the substrate. That is, the heat source 46 is configured to supply heat to the side of the substrate that recently received marking material in the image transfer structure 12. Accordingly, the heat source 46 can fix the marking material to the first side of the substrate. In an embodiment, the heat source 46 can be a hot air convection oven; however, other heat sources such as radiative heat sources, conductive heat sources, or the like can be used.

In an embodiment, the heat source 46 can be configured to heat the first side of the substrate to a temperature higher than the second side of the substrate is heated by the heated substrate transport 44. Using the example of 60° C. of the heated substrate transport 44, the heat source can heat the first side of the substrate to greater than about 70° C.

In an embodiment, a temperature of a previously fixed image can be raised to and/or held at a higher temperature. For example, the second side can be heated back to or above a temperature sufficient for fixing. As a result, when the first side and the second side of the substrate reach the fuser 20, the sides will have similar temperature histories. The sides can be heated in the fuser 20 in substantially the same way to achieve similar levels of gloss. In another example, the second side can be heated to a particular temperature such that when the first side and the second side arrive at the fuser 20, the sides have substantially similar temperatures. That is, the second side can be heated to a different temperature than the first side is by the heat source 46 to account for differences in heat transfer between the tacker 14 and the fuser 20.

In an embodiment, the path controller 16 can include a mechanical gate 48. The mechanical gate can guide the substrate between the first path 24 towards the fuser 20 and the second path 22 extending through the substrate inverter 18. The substrate inverter 18 includes a reversing structure 50. Accordingly, when the substrate is guided along the second path 22, it can be reversed in the reversing structure 50. As a result the second side of the substrate is presented to the image transfer structure 12 to receive marking material.

In an embodiment, the imaging system 30 can include a temperature control system 54 disposed in the second path 22. The temperature control system 54 can be configured to control a temperature of the substrate before transfer to the image transfer structure. In an embodiment, such temperature control can include passive or active cooling of the substrate. However, the temperature control system 54 can be configured to control the temperature of the substrate to any target temperature to achieve a desired temperature in the image transfer structure 12.

In an embodiment, the fuser 20 can have multiple stages. For example, the fuser 20 includes a first oven 32, a second oven 34, and a cooling zone 36. The first oven 32 can be a hot air oven configured to preheat the substrate while the second oven 34 can be a steam oven configured to heat the substrate to achieve a desire gloss, reflow the marking material, or the like. The cooling zone 36 can be configured to control a temperature of the substrate exiting the fuser 20 to a temperature suitable for further processing, if any. In each of such structures, transport structures having minimal contact with the substrate can be used to transport the substrate. For example, starwheels 38 can be used to transport the substrate having marking material on multiple sides through the fuser 20. In another embodiment, air jets can be used to transport the substrate.

An embodiment includes an imaging system including means for fixing marking material to a substrate; means for switching the substrate from the means for fixing between a first path and a second path; means for inverting the substrate and returning the substrate to the means for fixing disposed along the first path; and means for fusing marking material to a plurality of sides of the substrate disposed in the second path.

The means for fixing marking material to a substrate can include any of the structures described above with respect to the tacker 14. However, the means for fixing the marking material can include other structures such as the image transfer structure 12, controllers, or the like. The means for switching the substrate can include any of the structures described above with respect to the path controller 16. The means for inverting the substrate can include any of the structured described above with respect to the substrate inverter 18. The means for fusing marking material can include any of the structures described above with respect to the fuser 20.

An embodiment further includes means for cooling the substrate disposed along the first path. The means for cooling can include any of the structures described above with respect to the temperature control system 54 described above.

Although particular embodiments have been described, it will be appreciated that the principles of the invention are not limited to those embodiments. Variations and modifications may be made without departing from the principles of the invention as set forth in the following claims.

What is claimed is:

1. An imaging system, comprising:

an image transfer structure configured to transfer marking material to a first side of a substrate;

a tacker configured to fix the marking material to the substrate without fusing the marking material to the substrate;

a path controller;

a substrate inverter; and a fuser;

wherein the path controller is configured to switch the substrate between a first path towards the fuser and a second path extending through the substrate inverter and returning to the image transfer structure.

2. The imaging system of claim 1, wherein the fuser is configured to substantially symmetrically fuse marking material fixed to the first side of the substrate and fuse marking material fixed to the second side of the substrate.

3. The imaging system of claim 1, wherein the tacker comprises:

a heated substrate transport configured to support the substrate from the second side; and a heat source configured to supply heat to the first side of the substrate.

4. The imaging system of claim 3, wherein the heated substrate transport is configured to maintain the second side of the substrate at a temperature less than a temperature sufficient to substantially disturb fixed marking material.

5. The imaging system of claim 3, wherein:

the heated substrate transport is configured to hold the second side of the substrate at about 60 ° C. or below; and the heat source is configured to heat the first side of the substrate to greater than about 70 ° C.

6. The imaging system of claim 1, wherein:

the tacker is configured to heat the substrate to less than a threshold temperature;

the fuser is configured to heat the substrate to greater than or equal to the threshold temperature.

7. The imaging system of claim 6, wherein the threshold temperature is about 80 ° C.

8. The imaging system of claim 1, further comprising a cooling system disposed in the second path configured to cool the substrate before transfer to the image transfer structure.

9. The imaging system of claim 1, wherein the image transfer structure is configured to transfer marking material to only a single side of the substrate.

10. The imaging system of claim 1, wherein the tacker is configured to fix marking material to only a single side of the substrate.

11. An imaging system, comprising:

means for fixing marking material to a substrate without fusing the marking material to the substrate;

means for switching the substrate from the means for fixing between a first path and a second path;

means for inverting the substrate and returning the substrate to the means for fixing disposed along the first path; and means for fusing marking material to a plurality of sides of the substrate disposed in the second path.

12. The imaging system of claim 11, wherein the means for fixing the marking material to the substrate is configured to heat the marking material up to a temperature less than a temperature sufficient to reflow the marking material.

13. The imaging system of claim 11, wherein the means for fixing the marking material to the substrate is configured to heat the marking material on a first side of the substrate to a temperature sufficient to fix the marking material to the substrate and maintain the temperature of a second side of the substrate below a temperature sufficient to substantially disturb fixed marking material.

14. The imaging system of claim 11, further comprising means for cooling the substrate disposed along the first path.

15. A method of printing, comprising:

fixing marking material to a first side of a substrate in a tacker without fusing the marking material to the first side of the substrate;

switching the substrate between a first path towards a fuser and a second path;

inverting the substrate along the second path;

returning the inverted substrate to the tacker; and fixing marking material to a second side of the substrate in the tacker.

16. The method of printing of claim 15, further comprising switching the substrate to the first path after fixing marking material to the second side of the substrate.

17. The method of printing of claim 15, further comprising fusing the marking material on the first side of the substrate and the marking material on the second side of the substrate to the substrate.

18. The method of printing of claim 17, further comprising substantially simultaneously fusing the marking material on the first side of the substrate and the marking material on the second side of the substrate to the substrate.

19. The method of printing of claim 15, wherein fixing marking material to the second side of the substrate further comprises:

maintaining the first side of the substrate at a first temperature; and heating the second side of the substrate to a second temperature;

wherein the first temperature is less than the second temperature.

* * * * *